US006487299B1

(12) United States Patent
Peng

(10) Patent No.: US 6,487,299 B1
(45) Date of Patent: Nov. 26, 2002

(54) QUICK-DETACHABLE STRUCTURE FOR ON-WALL SPEAKER PANEL

(76) Inventor: Jack Peng, 9F, No. 21, Sec. 3, Min-Sheng E. Rd., Taipei (TW)

( * ) Notice: Subject to any disclaimer, the term of this patent is extended or adjusted under 35 U.S.C. 154(b) by 0 days.

(21) Appl. No.: 09/541,625

(22) Filed: Apr. 3, 2000

(51) Int. Cl.[7] ..... H04R 25/00
(52) U.S. Cl. ..... 381/395; 181/150
(58) Field of Search ..... 381/150, 386, 381/87, 332, 152, 395, 345, 189, 388, 391; 181/150, 199, 156, 155, 141; 40/700

(56) References Cited

U.S. PATENT DOCUMENTS 4,934,480 A * 6/1990 Gate et al. ..... 181/150
5,113,968 A * 5/1992 Lemmon ..... 181/148
5,221,814 A * 6/1993 Colbaugh et al. ..... 174/58
5,331,119 A * 7/1994 Leger et al. ..... 181/150

* cited by examiner

*Primary Examiner*—Sinh Tran
*Assistant Examiner*—Brian Ensey
(74) *Attorney, Agent, or Firm*—Dennison, Schultz & Dougherty

(57) ABSTRACT

Quick-detachable structure for on-wall speaker panel, including a frame body and a panel. An inner frame of the frame body is formed with a step section. Certain positions of the step section are formed with insertion notches for inserting with the panel. The panel is formed with large and small sound holes. One end of the panel is disposed with latch plates. Certain positions of the panel are formed with through holes for respectively connecting with rotary buttons with stop blocks. The latch plates of the panel are inserted in the insertion notches of the frame body. By means of rotating the rotary buttons, the stop blocks are engaged with or disengaged from the step section of the frame body. Therefore, the panel can be detached from the frame body without using any tool and the speaker can be conveniently installed.

3 Claims, 4 Drawing Sheets

QUICK-DETACHABLE STRUCTURE FOR ON-WALL SPEAKER PANEL

BACKGROUND OF THE INVENTION

The present invention relates to a quick-detachable structure for on-wall speaker panel, by which the panel can be detached from the frame body of the speaker without using any tool. Therefore, a speaker or the like can be conveniently installed on a fixed position (such as a wall).

When enjoying music or a movie, a surrounding stereo equipment is necessary for playing sound or music with high quality. The power of the speaker of the stereo equipment plays an important role in deciding the quality of the sound. In general, the greater the power of the speaker of the stereo equipment is, the larger the volume and weight of the speaker are. In order to keep a beautiful appearance of the indoor environment, the speakers are generally installed in a wall or a ceiling. Accordingly, when decorated, a speaker outer frame is previously mounted at a predetermined position. After the decoration is completed, the speaker is installed in the outer frame. However, when installing the speaker, it is necessary to use a power tool to detach the outer frame to facilitate installation of the speaker. However, it is inconvenient to operate such tool. Moreover, the indoor decoration may be incautiously damaged by such tool.

SUMMARY OF THE INVENTION

It is therefore a primary object of the present invention to provide a quick-detachable structure for on-wall speaker panel. According to such structure, the panel can be detached from the frame body of the speaker fixedly mounted on a wall without using any tool. Therefore, a speaker can be conveniently installed on a wall.

It is a further object of the present invention to provide the above quick-detachable structure for on-wall speaker panel, by which the speaker can be easily installed without damaging the indoor decoration.

According to the above objects, the quick-detachable structure for on-wall speaker panel of the present invention includes a frame body and a panel. An inner frame of the frame body is formed with a step section. Certain positions of the step section are formed with insertion notches for inserting with the panel. The panel is formed with large and small sound holes. One end of the panel is disposed with latch plates. Certain positions of the panel are formed with through holes for respectively connecting with rotary buttons with stop blocks. The latch plates of the panel are inserted in the insertion notches of the frame body. By means of rotating the rotary buttons, the stop blocks are engaged with or disengaged from the step section of the frame body. Therefore, the panel can be detached from the frame body without using any tool and the speaker can be conveniently installed.

The present invention can be best understood through the following description and accompanying drawings wherein:

DETAILED DESCRIPTION OF THE PREFERRED EMBODIMENT

Figure 1:
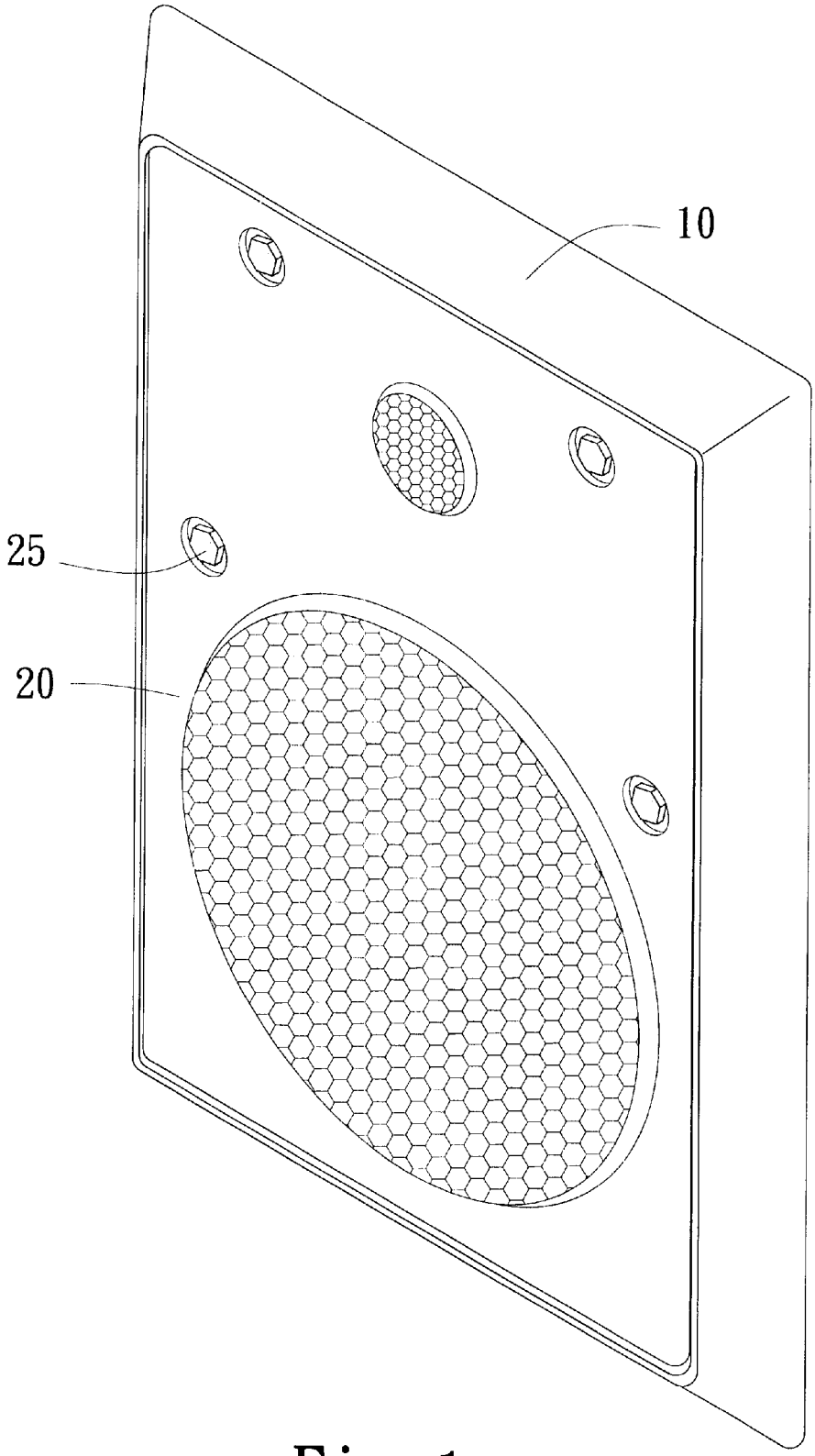
FIG. 1 is a perspective assembled view of the present invention.

Please refer to FIG. 1. The present invention includes a frame body 10 and a panel 20.

Figure 2:
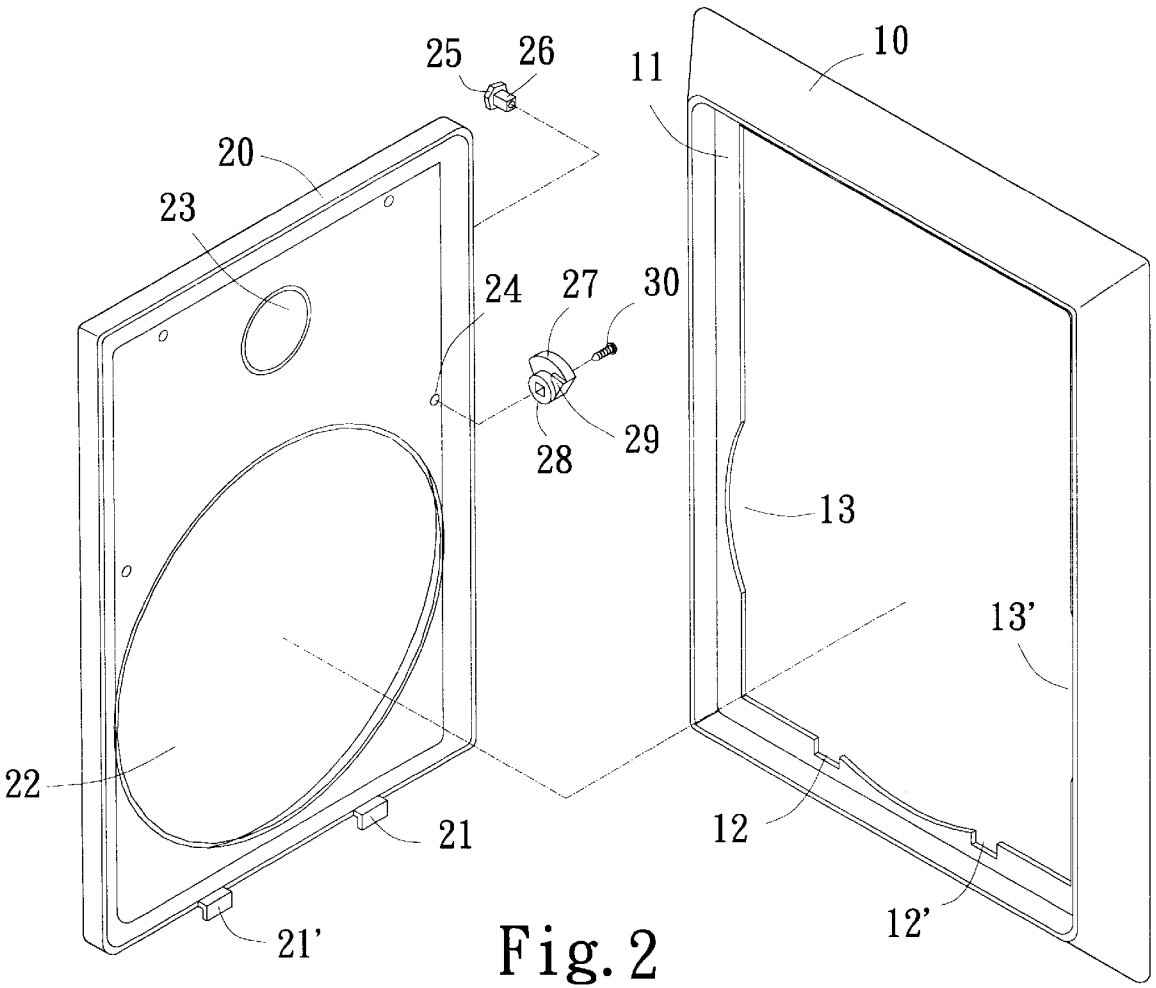
FIG. 2 is a perspective exploded view of the present invention.

Referring to FIG. 2, the inner frame of the frame body 10 is formed with an inward recessed step section 11. The bottom edge of the step section 11 is formed with two insertion notches 12, 12'. Two lateral sides of the step section 11 are formed with two arched notches 13, 13' near the bottom.

The panel 20 has a size corresponding to that of the inner frame of the frame body 10. The bottom edge of the panel 20 is disposed with two latch plates 21, 21'. The upper and lower sections of the panel 20 are respectively formed with a small and a large sound holes 23, 22. The periphery of the panel 20 is formed with several dented thread holes 24 above the small and large sound holes 23, 22 for locking multiple rotary button 25 and rotary plates 27. The bottom of the rotary button 25 has a projecting thread post 26. The rotary plate 27 is sector-shaped. The upper end of the rotary plate 27 has a fitting post 28. One side of the rotary plate 27 is disposed with a stopper block 29.

Figure 3:
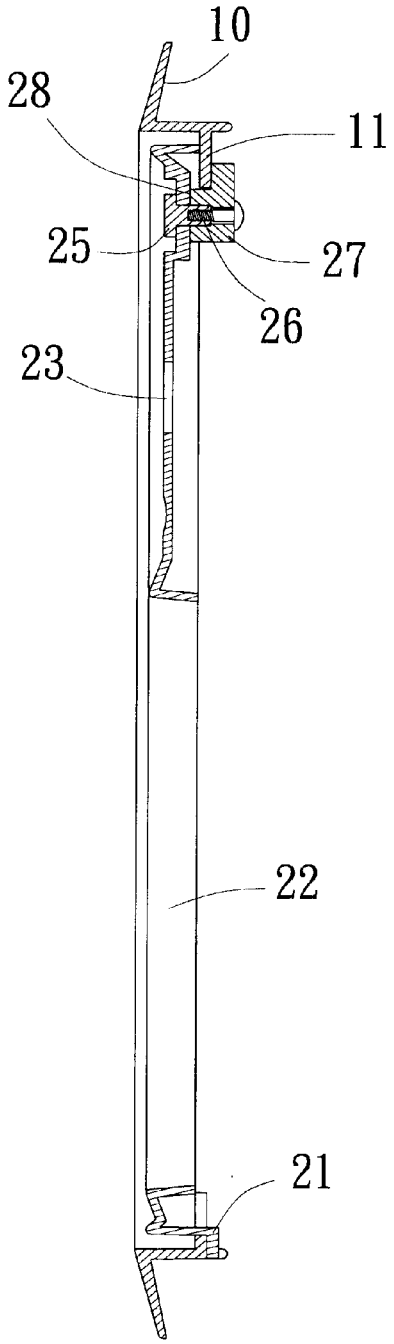
FIG. 3 is a sectional assembled view of the present invention.

The thread post 26 of the rotary button 25 is passed through the dented thread hole 24 from the front face of the panel 20. The fitting post 28 of the rotary plate 27 is fitted with the thread post 26 on the back face of the panel 20. A screw 30 is used to lock both on the panel 20. By means of rotating the rotary button 25, the rotary plate 27 on the back face is driven. As shown in FIG. 3, the latch plates 21, 21' of the bottom of the panel 20 are hooked and engaged in the insertion notches 12, 12' of the bottom edge of the frame body 10. Then the upper section of the panel 20 is pushed inward to make two sides of the large sound hole 22 of the panel 20 snugly positioned in the arched notches 13, 13' of the step section 11 of the frame body 10. Then the rotary buttons 25 are respectively rotated so as to rotate the arched bottom edges of the rotary plates 27 onto the step section 11 of the frame body 10 until the stop blocks 29 abut against the step section 11. Therefore, the panel 20 can be firmly located in the frame body 10.

Figure 4:
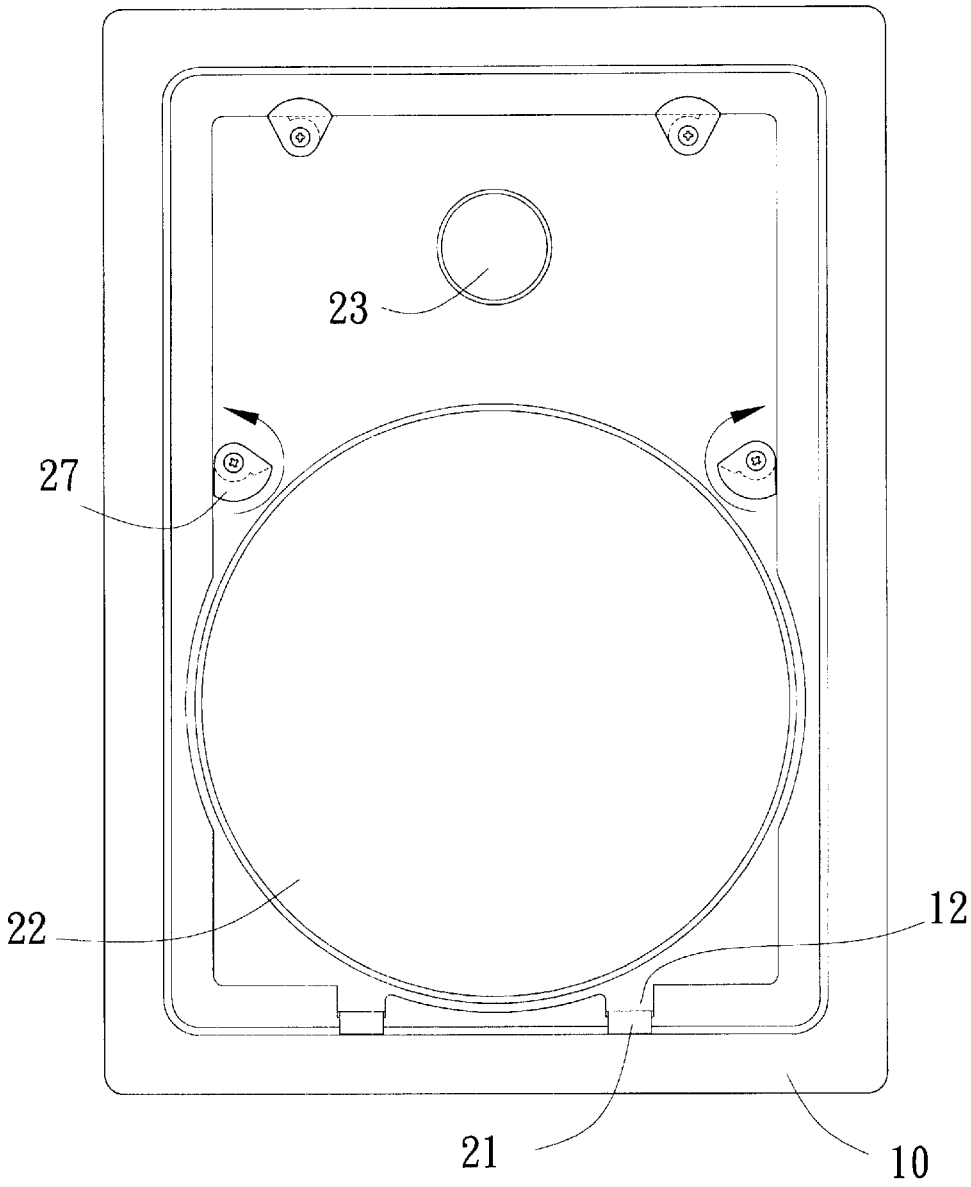
FIG. 4 is a back view of the present invention, showing the detachment of the panel from the frame body.

Reversely, when detaching the panel 20 from the frame body 10, as shown in FIG. 4, the respective rotary buttons 25 are reversely rotated. At this time, the arched bottom edges of the rotary plates 27 are rotated away from the upper sides of the step section 11 of the frame body 10. Then the upper section of the panel 20 is pulled outward and the latch plates 21, 21' of the bottom edge of the panel 20 are separated from the insertion notches 12, 12' of the frame body 10. Therefore, the panel 20 can be easily detached from the frame body 10 without using any tool. the panel 20 can be firmly located in the frame body 10.

The above embodiment is only used to illustrate the present invention, not intended to limit the scope thereof. Many modifications of the above embodiment can be made without departing from the spirit of the present invention.

What is claimed is:

1. Quick-detachable structure for on-wall speaker panel, comprising a frame body and a panel, an inner frame of the frame body being formed with a step section, certain positions of the step section being formed with insertion notches for inserting with the panel, one end of the panel being disposed with latch plates, certain positions of the panel being formed with several sound holes and through holes for respectively connecting with rotary buttons with stop blocks, the latch plates of the panel being inserted in the insertion notches of the frame body, by means of rotating the rotary buttons, the stop blocks are engaged with or disengaged from the frame body.

2. Quick-detachable structure for on-wall speaker panel as claimed in claim 1, wherein the rotary button has a sector-shaped rotary plate.

3. Quick-detachable structure for on-wall speaker panel as claimed in claim 2, wherein one side of the rotary plate is disposed with a projecting stop block with a certain length.

* * * * *